United States Patent [19]

Taliaferro

[11] 4,236,498

[45] Dec. 2, 1980

[54] SEE THROUGH FIREPLACE

[75] Inventor: James R. Taliaferro, Springtown, Tex.

[73] Assignee: Best Metal Products, Dallas, Tex.

[21] Appl. No.: 913,847

[22] Filed: Jun. 8, 1978

[51] Int. Cl.[3] ..... F24B 1/18

[52] U.S. Cl. ..... 126/120

[58] Field of Search ..... 126/123, 126, 4, 3, 126/125, 120, 121

[56] References Cited

U.S. PATENT DOCUMENTS

| | | | |
|---|---|---|---|
| 1,406,037 | 2/1922 | Langford | 126/125 |
| 2,821,975 | 2/1958 | Thulman | 126/120 |
| 3,123,063 | 3/1964 | Northwood et al. | 126/120 |
| 3,804,074 | 4/1974 | Illing | 126/125 |
| 3,970,067 | 7/1976 | Vaughn | 126/120 |
| 4,041,929 | 8/1977 | Cooksey | 126/120 |

OTHER PUBLICATIONS

Best Metals Products, Inc.–Factory–Built Fireplaces–May 9, 1978.

*Primary Examiner*—Samuel Scott
*Assistant Examiner*—Wesley S. Ratliff, Jr.
*Attorney, Agent, or Firm*—Richards, Harris & Medlock

[57] ABSTRACT

The specification discloses a prefabricated factory built fireplace for on site installation with a dual opening hearth. The fireplace has a firebox disposed over the hearth which is formed of two upstanding sidewalls with front and rear panels disposed therebetween. Each panel defines a relatively large rectangular opening for providing front and rear access to the hearth. A hood, disposed above the hearth and connected to the firebox, defines a flue in the top portion thereof for venting combustion products of the firebox into the chimney. The sidewalls of the firebox and the hood are formed of a triple insulated wall structure containing an outer, intermediate and inner casing. The outer casing is separated from the intermediate casing by insulation material and the intermediate casing is separated from the inner casing by an air passageway which communicates between the inside of the firebox and the flue.

6 Claims, 3 Drawing Figures

SEE THROUGH FIREPLACE

BACKGROUND OF THE INVENTION

1. Field of the Invention

The invention relates to fireplaces, and more particularly to prefabricated or factory built fireplaces.

2. Discussion of the Prior Art

Conventional prefabricated or factory built fireplaces with dual opening hearths have not been heretofore manufactured. Dual opening hearth fireplaces, of the so called see through design, are known in the art, but are usually built of brick or other construction material at the site. Many problems, especially with ventilation, have been encountered with such fireplaces and while they continue to be built, their performance is often not satisfactory.

Prefabricated, factory built fireplaces are highly desirable from the standpoint of economy of materials and savings in labor. Such fireplaces, usually fabricated of lightweight metal, can be easily transported to the construction site and quickly installed. In order that such fireplaces can provide service to two rooms, there is a need for a prefabricated fireplace with a dual opening hearth.

SUMMARY OF THE INVENTION

The present invention is directed to providing a suitably insulated and properly ventilated, factory built, dual opening hearth fireplace.

In accordance with one aspect of the present invention, a prefabricated fireplace has a firebox disposed over a hearth and formed of two upstanding sidewalls with front and rear panels disposed therebetween, each panel defining an opening to provide front and rear access to the fireplace. A hood, disposed above the hearth, is connected to the firebox for venting combustion products to a chimney. The hood and sidewalls are formed of a triple insulated wall structure containing an outer casing, an intermedmiate casing and an inner casing. The intermediate casing is separated from the outer casing by insulation material and separated from the inner casing by an air passageway communicating between the chimney and internally of the firebox to provide ventilation and insulation of the firebox.

BRIEF DESCRIPTION OF THE DRAWINGS

For a more complete understanding of the present invention and for further objects and advantages thereof, reference is now made to the following description taken in conjunction with the accompanying drawings in which.

DESCRIPTION OF THE PREFERRED EMBODIMENT

Figure 1:
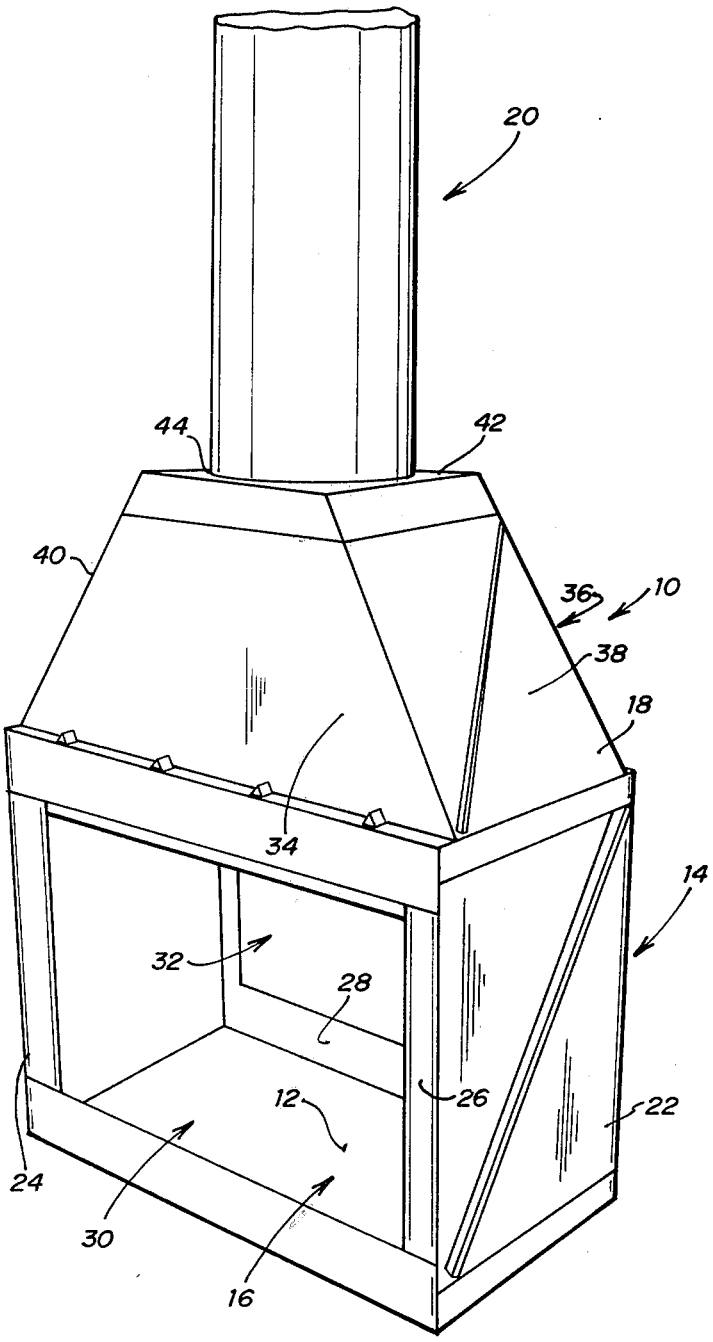
FIG. 1 is a perspective view of the present invention.

FIG. 1 shows a suitably insulated and properly ventilated dual hearth opening fireplace prefabricated at the factory and designed for immediate installation at the construction site. Fireplace 10 comprises a hearth 12, a firebox 14 surrounding the hearth to define a combustion chamber 16, and a hood 18 for venting the combustion product of chamber 16 to conventional chimney structure 20.

Firebox 14 is formed of two upstanding sidewalls 22 and 24 between which are disposed upstanding front and rear panels 26 and 28. Front and rear panels 26 and 28 define relatively large rectangular openings 30 and 32 which provide, respectively, front and rear access to hearth 12. Normally, fireplace 10 is installed in a wall between adjacent rooms so that one of the openings 30 and 32 will front on each room to provide access to the fireplace from either. However, the fireplace can also be installed in any other location provided only that fireplace openings 30 and 32 are no closer than 34 inches to the nearest sidewall.

The hood 18, which is disposed above hearth 12 is integrally joined to firebox 14 and shares common internal structure with sidewalls 22 and 24 as will be explained hereafter in greater detail. Hood 18 is a trapezoidal structure converging toward the top where fireplace 10 is connected to the conventional chimney structure 20. In the preferred embodiment, hood 18 has two vertical front and rear walls 34 and 36 and two inwardly sloping sidewalls 38 and 40, which converge to a rectangular top 42 in which is cut a properly dimensioned circular aperture 44 which permits hood 18 to vent into chimney structure 20.

Figure 2:
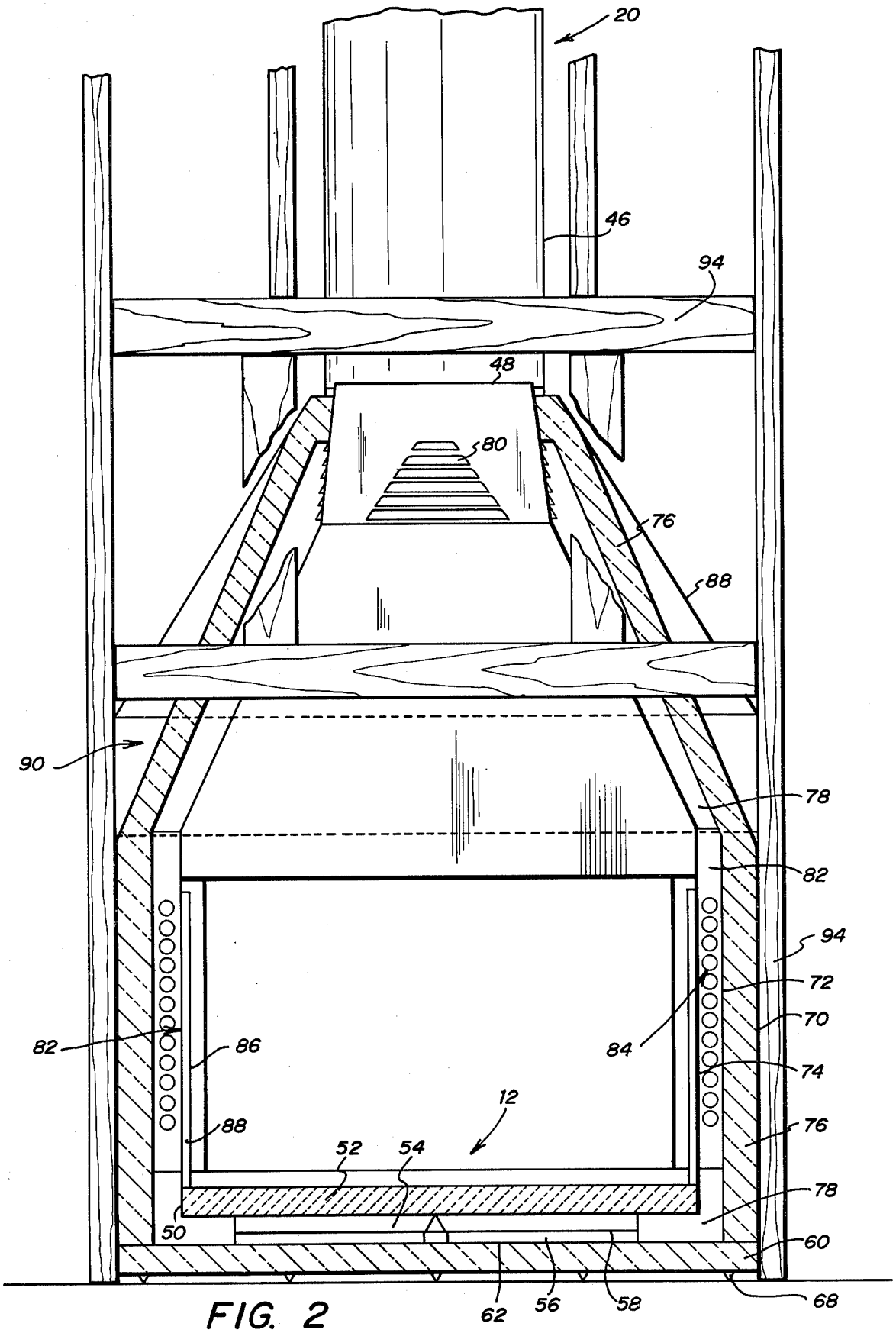
FIG. 2 is a section view of the present invention showing location of combustible material in direct contact with the sidewalls and hood thereof.

Referring now to FIG. 2 which shows the internal construction of firebox 14 and hood 18 in greater detail, a chimney pipe 46, which forms the lower part of chimney structure 20, is shown connected to top 42 of hood 18 to enclose aperture 44 which connects with a cylindrical flue 48 internal of the hood. Flue 48 is designed to vent gaseous combustion products of firebox 14 into the relatively narrow chimney pipe 46 as well as to facilitate the cooling and insulation of the hood and firebox and the ventilation of combustion chamber 16 as described hereafter in greater detail.

Referring now to the hearth 12 shown in FIG. 2, the prefabricated fireplace 10 contains a refractory case 50 manufactured of galvanized steel and designed to hold a suitable castable refractory mixture 52 which is composed of expanded shale, fire clay, firegrout and calcium aluminate. Mixture 52 is prepared on site and poured into case 50 where it is allowed to dry to form hearth 12. Refractory case 50 is insulated from the floor of the building in which fireplace 10 is located by two dead air spaces 54 and 56, which spaces are separated by a bottom heat shield 58 of aluminized steel. A suitable insulation material 60, such as mineral wool having a density of about six pounds per cubic foot, is disposed between air space 56 and the floor of the building. The insulation material 60 may be encased on the inside by an insulation cover 54 of aluminized steel and encased on the outside by a galvanized steel casing 66 which is integral with sidewalls 22 and 24 of the fireplace. The entire fireplace 10 may be further supported from the floor of the building by a bottom spacer 68.

As shown in FIG. 2, the two sidewalls 22 and 24 of firebox 14 and the four walls 34, 36, 38 and 40 of hood 18 have triple insulation wall structure defined by an outer casing 70, intermediate casing 72 and an inner casing 74. In the preferred embodiment, the outer casing 70 is manufactured of galvanized steel and is integral with the galvanized steel casing 66 enclosing insulation 60 beneath the hearth.

A suitable insulation material 76 such as a 2 inch thick layer of mineral wool having a density of about six pounds per cubic foot, is disposed between outer casing 70 and intermediate casing 72 to provide a layer of insulation between the firebox 14 and the outside. Intermediate casing 72 and inner casing 74 are manufactured of aluminized steel. The inner casing 74 is spaced apart substantially parallel to the intermediate casing 72 to define an air passageway 78 between casings 72 and 74. The air passageway 78 communicates with flue 48 near the top of hood 18 by means of a louver 80 disposed in flue 48. Air passageway 78 also communicates with combustion chamber 16 drawing air from the room and across hearth 12 up through passageway 78 into flue 48 to ventilate the fireplace and insulate outer casing 70.

As shown in FIG. 2, the sheet metal sections from which inner casing 74 is manufactured to form sidewalls 22 and 24 have flanges extending at right angles thereto which form the sidewalls 82 of air passageway 78. Sidewalls 82 are disposed between intermediate casing 72 and inner casing 74 and extend the length of the sidewalls 22 and 24 facing the front and rear openings 30 and 32 of the fireplace. Communication between combustion chamber 16 and passageway 78 is provided by a series of apertures 84 defined in each flange 82 which permits air to be drawn from the room into the fireplace and up through the flue 48 to provide additional ventilation required by dual opening hearth fireplaces. Although the apertures 84 open into combustion chamber 16, they are normally hidden from view by the sides of front and rear panels 26 and 28 as in FIG. 1.

The outer casing 70 of the firebox may be further insulated from combustion chamber 16 by firebox heat shields 86 which are mounted to the inner casing 74 at sidewalls 22 and 24. Heat shields 86 are rectangular plates of aluminized steel having inwardly turned flanges around the edges thereof which support the shields approximately one-half inch from the inner casing 74 to define a dead air space 88 therebetween.

As earlier pointed out, hood 18 is constructed of the same triple insulation wall structure of sidewalls 22 and 24 as may be the top portion 90 of front and rear panels 26 and 28 just above the openings 30 and 32 to the fireplace. The air passageway 78 in the vertical front and rear hood walls 34 and 36 and in the top portion 90 of front and rear panels 26 and 28 extends to the bottom of top portion 90 and communicates with the passageway 78 in sidewalls 22 and 24. In the preferred embodiment, the outer casing 70 of the side hood walls 38 and 40 may have a different slope from inner casing 74 and intermediate casing 72 to provide an additional air space 88 between insulation 76 and outer casing 70 to enhance insulation of the structure.

The triple insulated wall structure described herein not only provides additional ventilation required for a duel opening hearth fireplace, but provides sufficient insulation so that the insulated walls of the fireplace may be located in contact with combustible materials such as wood or plastic. The fireplace described herein has been tested and it has been found that under normal combustion, structure placed in contact with sidewalls 22 and 24 or hood walls 34, 36, 38 or 40 does not exceed ambient temperature by more than 115° F. at points of zero clearance from the walls, which meets the current standards established by Underwriters Laboratories. The fireplace may therefore be located in direct contact with combustible materials such as the wooden wall supports 94 shown in FIG. 2. Thus, the fireplace may be readily installed without additional insulation material.

Figure 3:
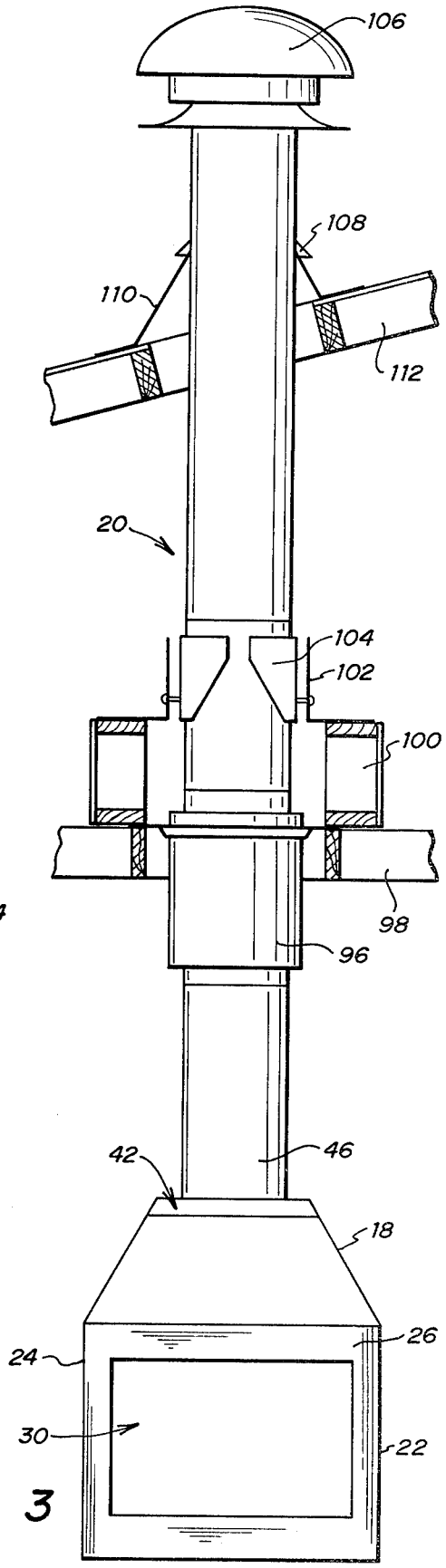
FIG. 3 is a front view of the present invention showing the chimney structure connected thereto.

Referring now to FIG. 3, the prefabricated fireplace 10 is shown connected to a commercially available prefabricated metal chimney structure 20. A minimum clearance of at least two inches may be required between chimney pipe 46 and combustible material such as wall supports 94 since such chimney structure 20 lacks the insulated structure of the present invention. Thus, the chimney structure 20 must be supported so that the minimum two inch clearance from wooden supports 94 is maintained. For this purpose, a joist shield 96 can be used to shield wood rafters 98 from chimney pipe 46 as it passes therethrough. A roof support system containing wooden roof supports 100, roof plates 102 and a chimnay pipe collar 104 as shown in FIG. 3 may be used to support the chimney structure and maintain the necessary clearance between the supports and the chimney structure. Additional appurtenances such as a conventional vent 106, storm collars 108 and flashing 110 disposed between roof 112 and chimney pipe 46 are conventional and normally part of any prefabricated chimney structure. This type of chimney structure, although not necessarily required by the invention, is desirable because of its commercial availability and ease of installation with applicant's prefabricated fireplace.

Although particular embodiments of the invention have been illustrated in the drawings and described herein, it will be understood that the invention is not limited to the embodiment disclosed, but is capable of rearrangement, modification and substitution of parts and elements without departing from the spirit of the invention.

What is claimed is:

1. A zero clearance dual opening hearth fireplace adapted to be capable of installation in contact with combustible material, comprising:

a firebox disposed over a hearth and formed of two upstanding side walls and front and rear panels, each of said panels defining an opening for providing front and rear access to the hearth;

a hood for connection with the chimney defining a flue internally thereof, said hood disposed above the hearth and connected to said firebox for venting said firebox into a chimney; and said walls and said hood having a triple insulated structure comprising an outer casing, an intermediate casing and an inner casing, said outer casing being separated from said intermediate casing by insulation material and said intermediate casing being separated from said inner casing by an air passageway, said insulation having sufficient thickness such that the temperature of said outside casing does not exceed 115° F. during combustion, wherein metal heat shields are mounted to the inside casing along the side walls of the firebox.

2. The fireplace of claim 1 wherein said flue includes a louver communicating with said air passageway and said air passageway contains openings for communicating internally of said firebox to permit air to be drawn from the firebox through the passageway into the flue.

3. The fireplace of claim 1 wherein said insulation is mineral wool having a density of at least six pounds per cubic foot.

4. The fireplace of claim 1 wherein said heat shields are provided with structure between said shields and said casing for defining a dead air space for insulating said inner casing from the firebox.

5. A prefabricated factory built fireplace adapted to be connected with a chimney designed for on site installation and capable of installation in contact with combustible material comprising:

a firebox disposed over a refractory hearth and formed of two upstanding metal side walls and upstanding front and rear panels disposed between said walls, each of said panels defining a relatively large rectangular opening dimensioned to provide front and rear access to the hearth;

a metal hood for connection with the chimney having a flue internally thereof, said hood disposed over said hearth and connected to said firebox for venting said firebox into the chimney;

said walls and said hood having a triple insulated structure containing an outer casing, an intermediate casing and an inner casing, said outer casing separated from said intermediate casing by mineral wool, said intermediate casing separated from said inner casing by an air passageway;

said air passageway communicating with the chimney via said flue, said passageway also communicating internally of said firebox; and said mineral wool having sufficient thickness and density whereby material placed in contact with said outer casing will not exceed 115° F. at points of zero clearance from said outer casing.

6. The fireplace of claim 5 wherein said hearth contains a layer of refractory in a metal case and said case is insulated from the floor of the construction site by a dead air space and by a layer of insulation material.

* * * * *